United States Patent [19]

Fendley

[11] Patent Number: 5,025,191

[45] Date of Patent: Jun. 18, 1991

[54] ADJUSTABLE-HEIGHT SHADOW MASK SUPPORT FOR A FLAT TENSION MASK COLOR CATHODE RAY TUBE

[75] Inventor: James R. Fendley, Arlington Heights, Ill.

[73] Assignee: Zenith Electronics Corporation, Glenview, Ill.

[21] Appl. No.: 454,223

[22] Filed: Dec. 21, 1989

[51] Int. Cl.[5] ..... H01J 29/07

[52] U.S. Cl. ..... 313/407; 313/402; 313/408

[58] Field of Search ..... 313/402, 403, 404, 406, 313/407

[56] References Cited

U.S. PATENT DOCUMENTS

| | | | |
|---|---|---|---|
| 2,824,989 | 2/1958 | Christofferson | 313/408 X |
| 3,894,321 | 7/1975 | Moore . | |
| 4,605,879 | 8/1986 | Rath | 313/408 X |
| 4,695,761 | 9/1987 | Fendley . | |
| 4,828,523 | 5/1989 | Fendley, et al. . | |
| 4,950,945 | 8/1990 | Fendley et al. | 313/402 X |

FOREIGN PATENT DOCUMENTS

| | | | |
|---|---|---|---|
| 0032260 | 3/1977 | Japan | 313/402 |
| 0135547 | 8/1983 | Japan | 313/402 |

*Primary Examiner*—Kenneth Wieder
*Assistant Examiner*—Ashok Patel

[57] ABSTRACT

A color cathode ray tube includes a glass faceplate having on its inner surface a centrally disposed, rectangular screen. A shadow mask support structure located on opposed sides of the screen includes Q-height adjustment means for receiving and securing the shadow mask. The Q-height adjustment means provides for Q-height adjustment of the mask support structure prior to the securing of the mask. A fixture sets and holds the support structure at a predetermined Q-height.

25 Claims, 4 Drawing Sheets

ADJUSTABLE-HEIGHT SHADOW MASK SUPPORT FOR A FLAT TENSION MASK COLOR CATHODE RAY TUBE

CROSS-REFERENCE TO RELATED APPLICATIONS

This application is related to but in no way dependent upon copending applications Ser. No. 140,464 filed Jan. 4, 1988 now U.S. Pat. No. 4,908,995; Ser. No. 178,175 filed Apr. 6, 1988 now U.S. Pat. No. 4,891,545; Ser. No. 223,475 filed July 22, 1988 now U.S. Pat. No. 4,902,257, and its two continuations-in-part: Ser. Nos. 370,204 filed June 22, 1989 and 405,378 filed Sept. 8, 1989; Ser. No. 269,822 filed Nov. 10, 1988 now U.S. Pat. No. 4,891,546; Ser. No. 292,196 filed Dec. 30, 1988; Ser. No. 421,909 filed Oct. 16, 1989; Ser. No. 427,149 filed Oct. 25, 1989, Ser. No. 458,129 filed Dec. 28, 1989, and Ser. No. 460,037 filed Jan. 02, 1990, all of common ownership herewith.

BACKGROUND OF THE INVENTION

Field of the Invention

This invention relates to color cathode ray picture tubes, and is addressed specifically to the manufacture of tubes having shadow masks of the tension foil type in association with a substantially flat faceplate. The invention is useful in the manufacture of color tubes of various types, including those used in home entertainment television receivers, and in medium-resolution and high-resolution tubes intended for color monitors.

The tension foil shadow mask is a part of the cathode ray tube front assembly, and is located in close adjacency to the faceplate. As used herein, the term "shadow mask" means an apertured metallic foil which may, by way of example, be about 0.001 inch thick, or less. The mask is supported in high tension a predetermined, precise distance from the inner surface of the faceplate known as the "Q-distance."

As is well known in the art, the shadow mask acts as a color-selection electrode, or "parallax barrier," which ensures that each of the three beams generated by the electron gun located in the neck of the tube lands only on its assigned phosphor deposits.

The requirements for a support means for a foil shadow mask are stringent. As has been noted, the foil shadow mask is normally mounted under high tension, typically 30 lb/inch. The support means must be of high strength so the mask is held immovable; an inward movement of the mask of as little as 0.0002 inch can cause the loss of guard band. Also, it is desirable that the shadow mask support means be of such configuration and material composition as to be compatible with the means to which it is attached. As an example, if the support means is attached to glass, such as the glass of the inner surface of the faceplate, the support means must have a coefficient of thermal expansion compatible with the glass, and by its composition, be bondable to glass. Also, the support means should be of such composition and structure that the mask can be secured to it by production-worthy techniques such as electrical resistance welding or laser welding. Further, it is essential that the support means provide a suitable surface for mounting and securing the mask. The material of which the surface is composed should be adaptable to machining or other forms of shaping so that it can be contoured into near-perfect flatness so that no voids between the metal of the mask and the support structure can exist to prevent the positive, all-over contact required for proper mask securement.

Tension mask support structures have comprised a metal alloy cemented directly to the glass of the faceplate; examples of this type of assembly include, among others of common ownership herewith, those fully described and claimed in referent copending application Ser. Nos. 178,175 and 269,822. Tension mask support structures have also comprised ceramics cemented to the glass of the faceplate; examples of this type of assembly include, among others of common ownership herewith, those fully described and claimed in U.S. Pat. No. 4,737,681 and referent copending applications Ser. Nos. 269,822, 292,197 and 366,478. Further, the ceramic mask support may be discontinuous or "segmented," as described and claimed in referent copending application Ser. No. 421,909, a pending reissue of U.S. Pat. No. 4,730,143, also of common ownership herewith, and in referent copending application Ser. No. 427,149.

To forestall cracking or spalling of the glass of the the support structure to the glass of the faceplate, it is essential that the coefficients of thermal contraction ("CTC") of the glass of the faceplate, the metal used in a tension mask support structure, and the devitrifying solder glass (known coloquially as "frit"), used for cementing the structure to the faceplate, be compatible.

Significant factors in the manufacture of a tension mask support structure include: (1) the cost of the materials of the structure; (2) the compatibility of the composition of the support structure with the glass of the faceplate; (3) the flatness/parallelism of the structure; and most important, (4), the exactness and regularity of the Q-height.

Machining operations such as grinding or lapping e.g. have in the past provided for establishing exactness and regularity of Q-height of a support structure for a flat tension mask. A process for grinding a support structure to a desired Q-height is set forth in referent copending application Ser. No. 140,464, of common ownership herewith.

Other Prior Art

U.S. Pat. Nos. 3,894,321 to Moore; 4,695,761 to Fendley; and 4,828,523 to Fendley et al.

OBJECTS OF THE INVENTION

It is a general object of the invention to provide means and a process for facilitating the manufacture of color cathode ray tubes having a tensed foil shadow mask.

It is an object of the invention to provide a process for use in the manufacture of tension mask faceplate assemblies that simplifies manufacture and reduces manufacturing costs.

It is an object of this invention to provide means and process that contribute to the feasibility of manufacture of flat tension mask color cathode ray tubes having interchangeable shadow masks.

It is another object to provide a tension mask support structure having improved flatness and Q-height uniformity.

It is yet another object of the invention to provide a mask support structure that can be installed following application of the screen.

It is a further object of the invention to provide a mask support structure that does not require in situ grinding.

It is an object of the invention to provide a mask support structure that does not impede the application of the screen to the faceplate.

It is yet another object to provide a mask support structure in which the Q-height can be selectively varied.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (not to scale), in the several figures of which like reference numerals identify like elements, and in which:

DESCRIPTION OF THE PREFERRED EMBODIMENT

Figure 1:
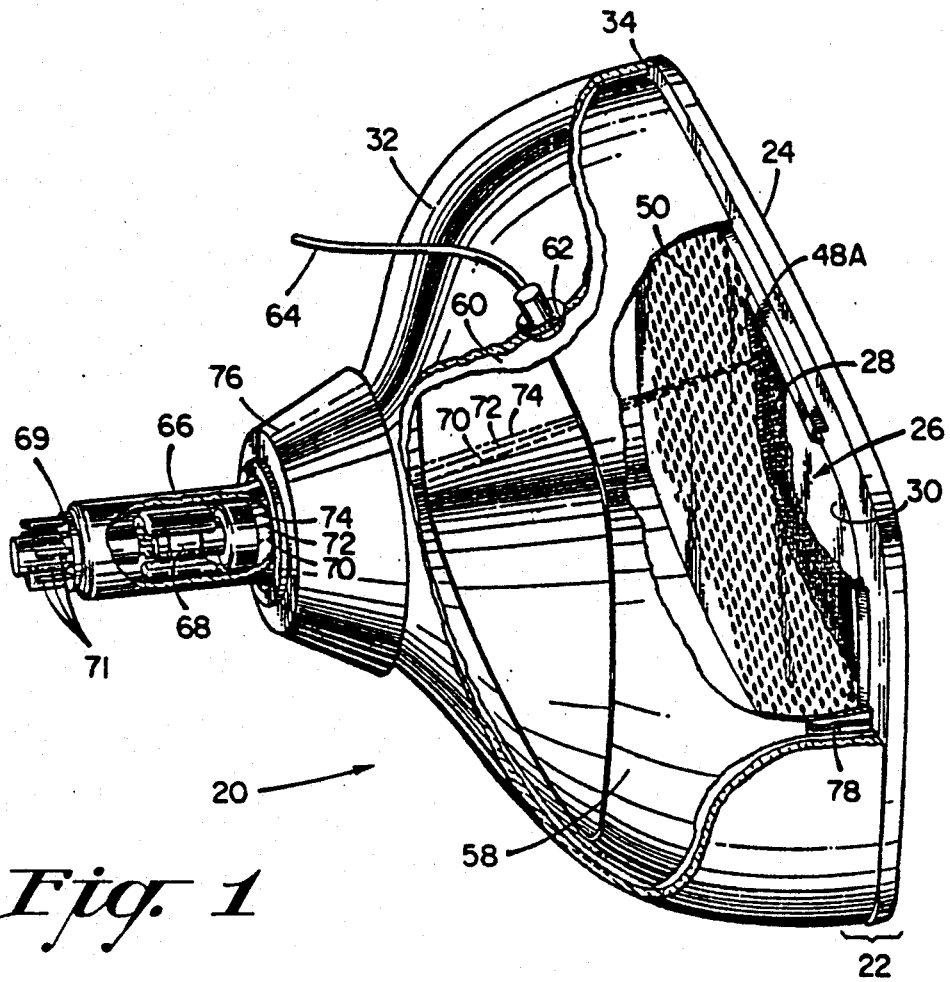
FIG. 1 is a side view in perspective of a tension mask color cathode ray tube having an adjustable-Q shadow mask support structure, with cut-away sections that indicate the location and relationship of the major components of the tube.
Figure 2:
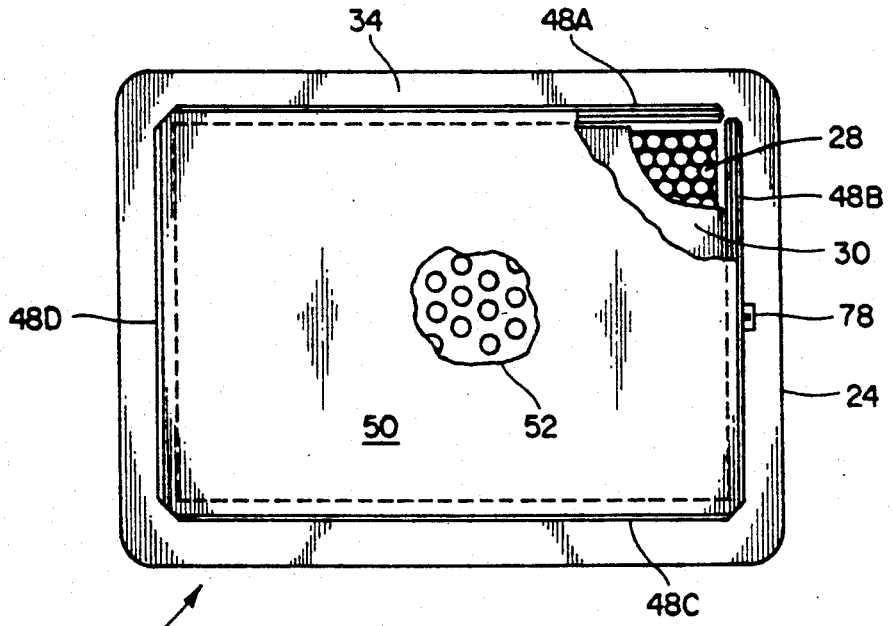
FIG. 2 is a plan view of the front assembly of the tube shown by FIG. 1, with parts cut away to show the relationship of the faceplate with the adjustable-Q shadow mask support structure and shadow mask; insets show mask apertures and phosphor screen patterns greatly enlarged.
Figure 3:
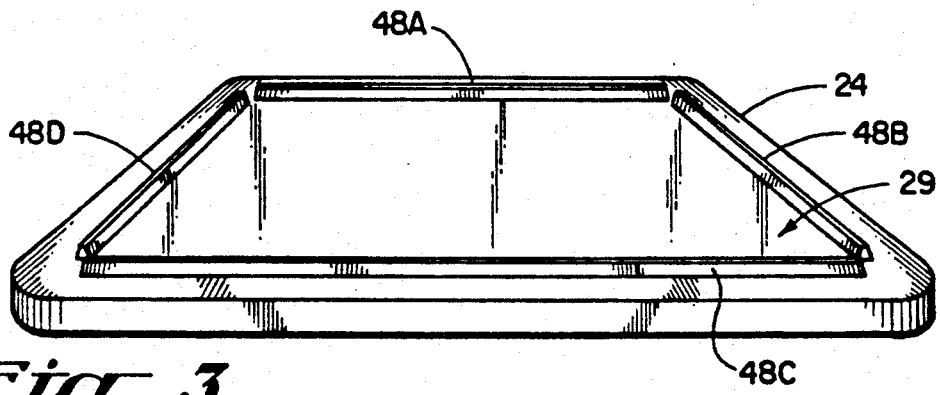
FIG. 3 is a view in perspective of a cathode ray tube faceplate having an adjustable-Q mask support structure according to the invention mounted on opposed sides of a centrally disposed screening surface.

A color cathode ray tube having an improved mask support structure according to the invention is depicted in FIGS. 1, 2 and 3.

Color cathode ray tube 20 has a front assembly 22 that includes a glass faceplate 24. A centrally disposed, multi-color phosphor screen 28 is formed on the inner surface 26 of faceplate 24. The round deposits of phosphor, shown as surrounded by the black matrix, are depicted greatly enlarged. Note that a benefit of support structures having Q-height adjustment means according to the invention lies in the fact that the screen 28 may be formed, unlike the present practice, before the installation of the mask support structure on the inner surface of the faceplate. The centrally disposed area 29 on the inner surface 26 of the faceplate 24, designated as "the screening surface" (see FIG. 3), is the area on which the screen 28 is to be formed.

A film of aluminum 30 is indicated as covering the screen 28. The peripheral sealing area 34 of faceplate 24 is adapted to mate with the peripheral sealing area of funnel 32.

The shadow mask support structure 48 according to the invention is indicated in this embodiment as comprising four discrete "rails" 48A, 48B, 48C and 48D located on opposed sides of the screen 28 and secured to inner surface 26 of faceplate 24. The support structure may as well comprise a unitary, one-piece structure.

After being tensed, the metal foil shadow mask 50 is mounted on support structure 48 and secured thereto. The shadow mask apertures 52 are indicated as greatly enlarged in the inset for illustrative purposes; there is one aperture for every triad of phosphor deposits. A magnetic shield 58 is shown as being enclosed within funnel 32. High voltage for tube operation is indicated as being applied to an internal conductive coating 60 on the inner surface of funnel 32 by way of an anode button 62 connected in turn to high-voltage conductor 64.

The neck 66 of tube 20 is represented as enclosing an in-line electron gun 68 which provides three discrete in-line electron beams 70, 72 and 74 for exciting the respective red-light-emitting, green-light-emitting, and blue-light-emitting phosphor deposits on screen 28. Metal pins 71 conduct operating voltages and video signals through base 69 to electron gun 68. Yoke 76 provides for the traverse of beams 70, 72 and 74 across screen 28. A contact spring 78 provides an electrical path between the funnel coating 60 and the mask support structure 48, and the shadow mask 50.

A color cathode ray tube having an adjustable Q-height mask support structure according to the invention includes a glass faceplate 24 having on its inner surface 26 a centrally disposed, rectangular screen 28. A metal foil shadow mask 50 is mounted in tension on a mask support structure shown as comprising four discrete rails 48A, 48B, 48C and 48D, indicated as being located on opposed sides of screen 28 and secured to the inner surface 26 of faceplate 24. The mask support structure includes Q-height adjustment means according to the invention for receiving and securing mask 50; the Q-height adjustment means provides for Q-height adjustment prior to the securing of mask 50.

Figure 4:
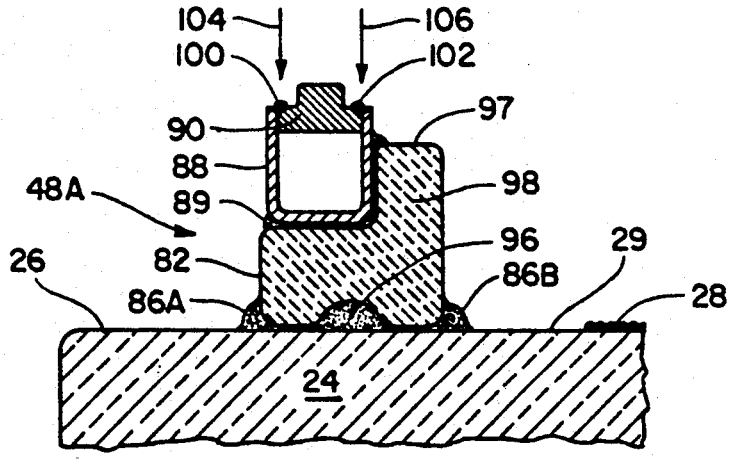
FIG. 4 is a view in elevation of a cross-section of a preferred embodiment of an adjustable-Q mask support structure according to the invention.

With reference to FIG. 4, there is depicted in greater detail an embodiment of a shadow mask support structure according to the invention, indicated as rail 48A, and representative of the rails depicted in FIG. 1–3, all of which have identical parts. Rail 48A of the shadow mask support structure comprises first means 82, shown symbolically as being composed of a ceramic, is depicted as being attached to the inner surface 26 of a faceplate 24 by deposits of a cement 86A and 86B. A second, U-shaped metal means 88, is shown as being attached to first means 82; the means of attachment are indicated as comprising an intervening layer of cement 89, indicated by the stipple pattern. U-shaped metal means 88 provides for slidably receiving an adjustable member 90A, also indicated as being composed of metal. Adjustable member 90A provides in turn for receiving and securing a foil shadow mask in tension, as will be described.

N.B. In the context of this disclosure, the terms "slidable" or "slidably" connote two types of fit: (1) an "easy" slip fit in which the adjustable member can move in response to a very light force, such as the pull of a contacting magnet, and (2), a "press" fit which the slidable member will remain firmly in place after being moved by a substantial mechanical force.

The deposits of cement 86A, 86B and 89 may comprise a devitrifying solder glass such as, for example, solder glass No. CV-685 manufactured by Owens-Illinois of Toledo, Ohio. Alternately, second means 88 may be secured to ceramic first means 82 by a porcelain enamel such as that manufactured by Mobay Corporation, Baltimore, Md., under the designation QJ350. This product, which is supplied in the form of a powder, is preferably mixed with amyl acetate and nitrocellulose to make a paste of workable viscosity. Heating incidental to the manufacturing process results in setting of the enamel and firm adhesion of the metal of U-shaped second means 88 to the ceramic body of first means 82.

Deposits 86A and 86B comprise fillets of devitrifying solder glass described in the foregoing. Fillets 86A and 86B are not the sole means of attaching a support structure to a faceplate, but rather comprise an extension of a bed of solder glass about 5 mils thick (not indicated) which lies between the bottom of the support structure and the faceplate, and which effectively bonds the two together.

The attachment of the ceramic body of first means 82 to the inner surface 26 of faceplate 24 is aided by groove 96, shown as being in the area of securement of the ceramic body to the faceplate. This groove, which runs lengthwise in the ceramic body 98 of first means 82, provides for receiving and forming a lengthwise bead of solder glass, indicated by the stipple pattern. The combination of ceramic body 98 of first means 82 and the solder glass in the groove 96, provides for pre-stressing faceplate 24 in the area of interface to enable the glass of the faceplate to tolerate wide temperature excursions experienced during production. The concept of a lengthwise groove in a mask support structure is the subject of referent copending application Ser. No. 292,197, of common ownership herewith.

The inventive process for installing the mask support structure comprising rail 48A and its companion rails 48B, 48C and 48D comprises the following. A multicolor phosphor screen 28 is formed on the screening surface 29. Thereafter, the four rails are secured to inner surface 26 on opposed sides of the screen 28. The rails are equipped with Q-height adjustment means for receiving and securing a shadow mask; the Q-height adjustment means of the FIG. 4 embodiment is shown as comprising a U-shaped metal means 88 slidably receiving an adjustable member 90A. While adjustable member 90A is adjusted at a predetermined Q-height, adjustable member 90A is welded to U-shaped metal means 88 to fix it into position; two weldments 100 and 102 are indicated. Welding may be accomplished by at least one high-energy-density beam, as for example, as a laser beam; the paths of two welding beams are indicated by arrows 104 and 106.

Figure 5:
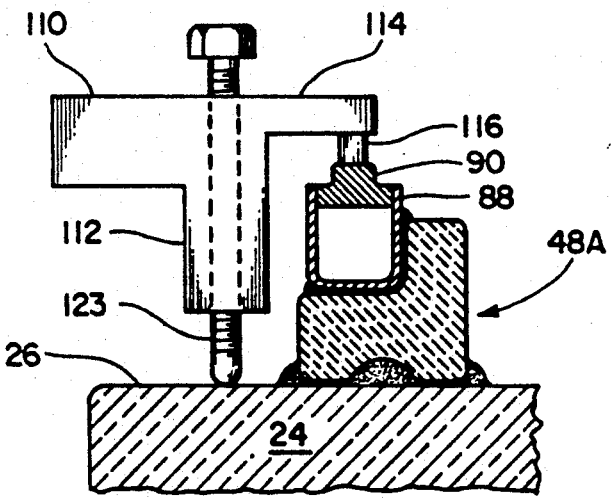
FIG. 5 is an elevational view showing in cross-section the support structure embodiment of FIG. 4 in relation to a fixture according to the invention for adjusting Q-height prior to securing a shadow mask to the structure.
Figure 6:
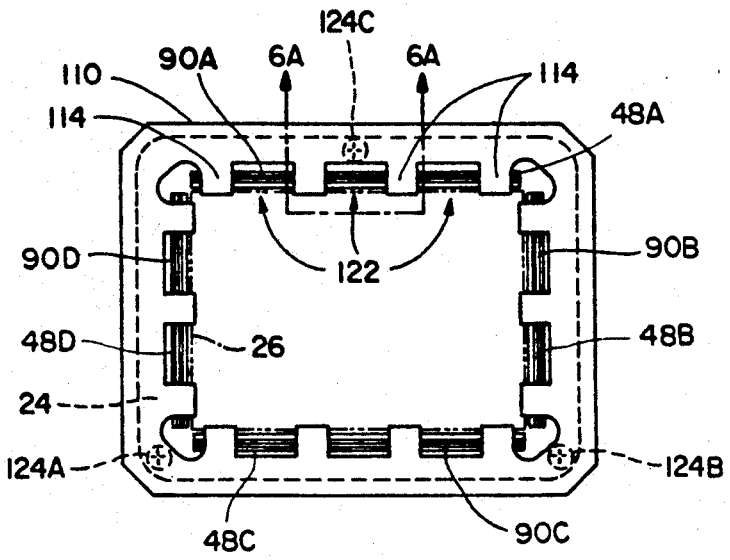
FIG. 6 is a plan view of the fixture depicted in FIG. 5 that indicates its relationship to the support structure and faceplate, and showing details of the fixture according to the invention and its use in establishing and holding the Q-height adjustable means to a predetermined Q-height.
Figure 7:
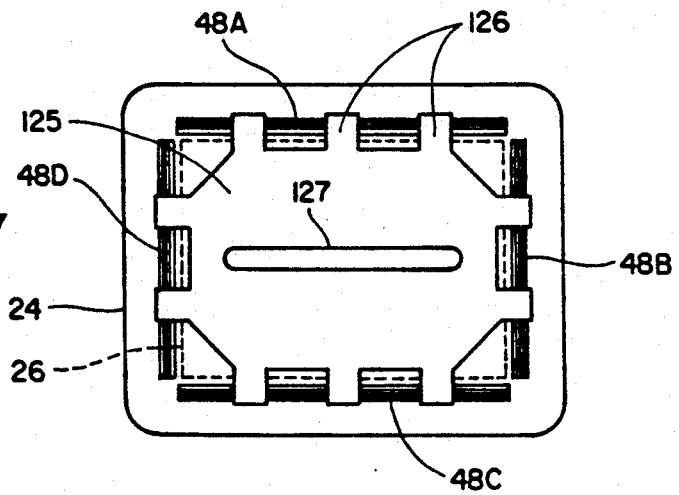
FIG. 7 is view similar to FIG. 6 showing an ancillary hold-down device laid over the faceplate and the support structure.

The process of setting the Q-height of a shadow mask support structure prior to its receiving a mask requires the use of an inventive fixture, an embodiment of which is depicted schematically in FIGS. 5–7. With reference first to FIG. 5, fixture 110 is depicted as having gauging means comprising a base 112 for contacting the inner surface 26 of faceplate 24. Base 112 provides for setting the Q-height adjustment means (noted as comprising adjustable means 90A slidably engaged with U-shaped member (88) to the proper Q-height. Fixture 110 includes holding means 114 to which is attached magnetic means 116 which in turn firmly holds adjustable means 90 to the proper Q-height.

Figure 6A:
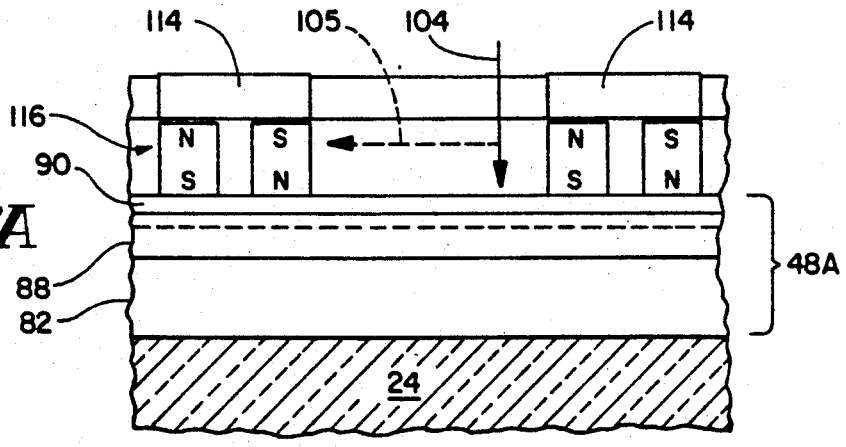
FIG. 6A is an elevational view of a section of FIG. 6 taken along sight-line 6A—6A.

Holding means 114 is depicted in FIG. 6 as comprising a series of fingerlike projections 118 overlying the rails 48A–48D as installed on the underlying faceplate 24, the perimeter of which is indicated by the dash lines. With reference to FIG. 6A, each fingerlike projection 118 of holding means 114 is indicated as having magnetic means 116 depending therefrom, and in adhering contact with the Q-height adjustable means 90A of rail 48A. The magnetic means 116 may comprise electromagnets which can be switched on and off, or permanent magnets which can be mechanically withdrawn after their holding function has been exercised.

Fixture 110 will be noted as providing access for welding beams to the adjustable means 90A; the paths of the beams are indicated by arrows 104 and 106 in FIG. 4. Welding beam access is provided by spaces between the fingerlike projections 118, as indicated by spaces 122 in FIG. 6, shown as providing passage for a welding beam 104. The traverse of the beam is indicated by arrow 105.

The welding procedure comprises two steps, using the embodiment of FIG. 4 as an example. In a first pass of the welding beams 104 and 106, adjustable means 90A is first tack-welded to U-shaped second means 88, with the beams passing between the fingerlike projections 118 of holding means 114. Fixture 110 can then be removed, and in a final welding pass, beams 104 and 106 provide continuous seam welds in the areas shown by weldments 100 and 102 in FIG. 4. If a laser is used for welding, energy of a few joules is needed for each of the track welds. Following the tack welding, seam welding can be accomplished at a rate of a few inches per second, using a 500 watt $CO_2$ continuous beam laser. Fixture 110 may be designed to incorporate high-energy-density beam welding means in its structure (not shown), or the welding component may comprise a separate machine placed in fixed adjacency to fixture 110.

Prior to the welding step, it is necessary to map the rails to provide a precise path for the welding beams to follow. Rail mapping means is fully described and claimed, with respect to welding and severing of a foil mask, in U.S. Pat. No. 4,828,524 to Fendley, of common ownership herewith. The mapping procedure can be adapted to guide a welding beam to make weldments 100 and 102 of FIG. 4, for example. The exact placement of such weldments is critical to the proper implementation of the present invention.

A centrally disposed rectangular screen 26 is noted as having been previously formed on faceplate 24; that is, prior to the securing of the support structure 48 on opposed sides of screen 28. As a cathodoluminescent multi-color screen is highly sensitive to contaminants and weld splatter, it is necessary to shield it with a cover (not shown) using, by way of example, a simple flat plate having a handle. The cover can be supported and spaced from the screen by the adjacent shoulders of the support structure, such as shoulder 96A shown by FIG. 4.

With reference again to FIG. 5, base 112 is depicted as having Q-height setting means 123 indicated symbolically, and by way of example, as comprising micrometer screw means. Precision servo motors could as well be used. The setting means provides for conforming fixture 110 to provide predetermined, different Q-heights. With reference to FIG. 6, three locations 124A, 124B and 124C are indicated which may comprise the location of either adjustable screw means, or fixed means, as installed in the fixture 110. The three locations provide for the three-point adjustment of Q-height of the mask support structure.

Figure 5A:
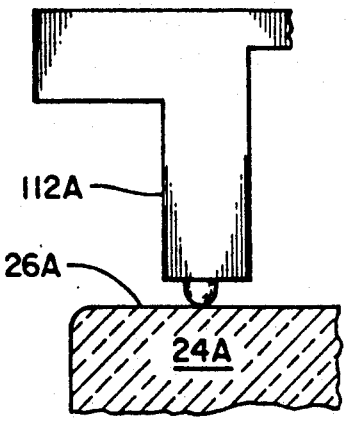
FIG. 5A is a similar view showing one of three non-adjustable panel reference plane tooling balls for contacting the faceplate.

It is noted that base 112 need not have means for setting fixture 110 to provide a predetermined triplet of Q-heights, but rather comprise a non-adjustable base that provides a fixed Q-height A base of this type is indicated by FIG. 5A. Base 112A is shown as extending to the inner surface 26A of faceplate 24A, with a ball member shown as being in actual contact with the inner surface of the faceplate.

With regard to the means for setting Q-height, such as the screw means 123 indicated by FIG. 5, this concept has particular relevance to the interchangeable mask system which is the subject of referent copending applications Ser. No. 223,475 and its two continuations-in-part: Ser. Nos. 370,204 and 405,378. For example, it may be desired to tilt the shadow mask out of the plane of the screen to provide a "wedge" shape to the mask in relation to the plane of the screen. Such tilting can provide compensation for errors in screen printing in an interchangeable mask system. Tilting can readily be accomplished by varying the Q-height by the three-point adjustment means described. Either the adjustable screw means or the fixed means may be set specifically for this purpose. If the Q-height adjustment means is set to provide such a tilted mask, additional instrumentation will be required such as optical instruments or electromechanical probes to ensure that the mask receiving surface of the inserts (e.g., insert 90) are flat, and at the desired wedge angle with respect to the screen.

To ensure that the adjustable means 90A, 90B, 90C and 90D lie substantially in a single plane so that they may be readily grasped by the magnetic means 116, a spider-like retaining fixture 125 is indicated in FIG. 7 as being installed over faceplate 24. It is pressed down manually to a predetermined depth (such as the depth provided by the shoulders of the support structures—see shoulder 97 indicated in FIG. 4, for example), after which fixture 110 is put in place, and the magnetic means activated to fix the movable members at the proper Q-height. Fixture 125 is then removed. Retaining fixture 125 is indicated as having fingerlike projections 126 which are designed to pass between spacings 122 of fixture 110, and contact the adjustable means 90A–90D of rails 48A, 48B 48C and 48D. A handle 127 is provided for the manual installation and removal of the fixture.

A modification of the fixture 110 shown by the plan view of FIG. 6 may be used to press the adjustable members of the rails down into the U-shaped members, providing for the press fit described heretofore. In such a modified fixture (not shown), the spacings 122 between fingerlike projections of the holding means 114 would be substantially reduced, leaving only enough space for tack welding. Also, the magnetic means 116 would be replaced with appropriate contact buttons. Such a modified fixture would provide the "press fit" described heretofore, in which firm mechanical pressure is required to push the adjustable member to the proper depth; i.e., the proper Q-height. Once at the proper Q-height, the adjustable members of the four rails would remain in place because of the tightness of the fit, and the modified fixture could then be removed to provide access for the final seam welding.

Figure 8:
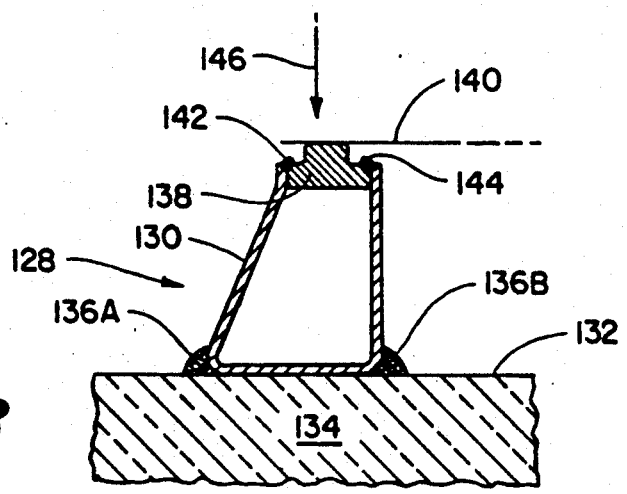
FIGS. 8, 9 and 10 are cross-sectional views in elevation of further embodiments of mask support structures having Q-height adjusting means according to the invention.
Figure 9:
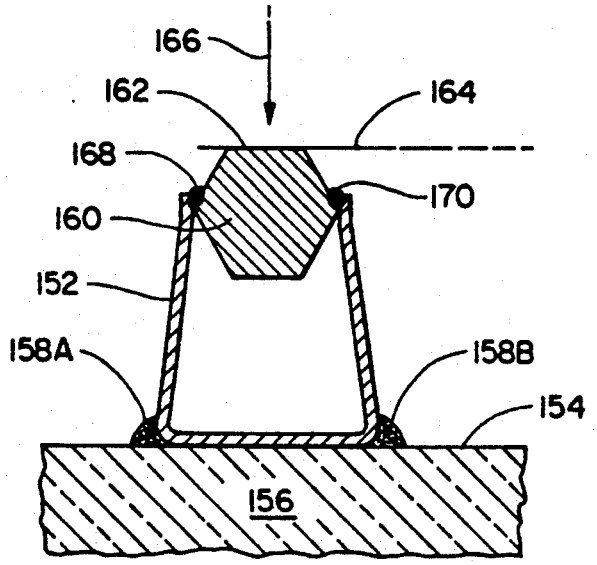
Figure 10:
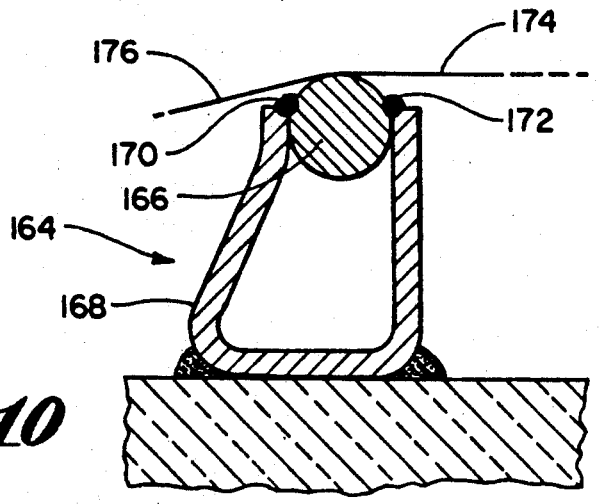

Further embodiments of Q-height adjustment means according to the invention the invention are shown by FIGS. 8, 9 and 10.

Note: These embodiments are depicted with the shadow mask installed; a screen can have been first formed on the screening surface, then the mask support structure installed and its Q-height fixed prior to the installation of the mask.

The mask support structure 128 of FIG. 8 is indicated as comprising a U-shaped structure 130 noted as being secured on opposed sides of the screen (not indicated) to the inner surface 132 of a faceplate 134 by beads of solder glass with fillets 136A and 136B. U-shaped structure 130 is indicated as having Q-height adjustable means 138 slidable in the U-shaped structure 130 which provided for Q-height adjustment of a shadow mask 140 prior to the securing of the mask.

As noted, the embodiment is shown following the adjustment of the Q-height according to the invention, and the affixing of the Q-height adjustment means 138 is indicated by weldments 142 and 144. Mask 140 is affixed to the Q-height adjustment means 138 by a high-energy density beam, preferably a laser beam; the path of the beam in performing the weld is indicated by arrow 146. Laser welding means for securing a foil mask to a support structure is not the subject of the present application, but that of U.S. Pat. No. 4,828,523 and copending application Ser. No. (D6100), both of common ownership herewith.

The embodiment of a mask support structure according to the invention depicted in FIG. 9 will be noted as being similar to structure 128 depicted by FIG. 8 in that it has an upright, U-shaped member 152 which is secured on opposed sides of the screen (not indicated) to the inner surface 154 of a faceplate 156 by beads of solder glass 158A and 158B. U-shaped member 152 is indicated as slidably holding a Q-height adjustable means 160 which is in the shape of a polygon, with a flat side 162 of the polygon uprightly oriented for receiving and securing a shadow mask 164 as by a welding beam, the path of which is indicated by arrow 166. Polygonal Q-height adjustment means 160 is fixed in position at a predetermined Q-height by welding, as indicated by weldments 168 and 170. The Q-height adjustment 160 provided by this embodiment of a mask support structure can readily be accomplished by fixture 110 depicted in FIG. 5.

The inventive embodiment of FIG. 10 is similar to that of FIG. 9 in that the Q-height adjustable means of a support structure 164 comprises a metal member 166 round in cross-section which is slidable in a generally U-shaped metal member 168. The predetermined Q-height is adjusted according to the invention, using a fixture such as that depicted in FIG. 6, and metal member 166 is welded to U-shaped member 168, as indicated by weldments 170 and 172. A foil shadow mask 174 is then tensed and secured to metal member 166 as by welding. The rounded surface of member 166 provides a conforming seat over which the thin foil of the mask can be bent without undue stressing of the material of the mask. The end section 176 of mask is indicated as having been pulled in a downward direction when tensing the mask; this indicates what is known as the "positive interference" mounting of a shadow mask in which the mask is pulled down firmly against the support structure during the tensing process. The amount of such interference is preferably in the range of 5 to 10 mils.

The metal components of the mask support structures having Q-height adjustment means as described preferably comprises Alloy No. 27 manufactured by Carpenter Technology of Reading, Pa.; this material has a CTC (coefficient of thermal contraction) compatible with faceplate glass; that is, approximately 105 to $109\times10^{-7}$ in/in/degree C. over the range of the temperatures required for devitrification—from ambient temperature to 450 degrees Alloys having equivalent characteristics supplied by other manufacturers may as well be used.

A preferred composition for the ceramic component of the segments of the support structure according to the invention comprises, in percentages, magnesia, 27; talc, 63; barium carbonate, 6; and ball clay, 4. The coefficient of thermal contraction of this composition, when used for at least selected ones of the segments, is effective to put the glass beneath the segments into a predetermined degree of tension, such as, by way of example, a tension of greater than 800 psi. As a result, the tube assembly can withstand the wide temperature excursions experienced during production. The composition of ceramic cited, and the effect different compositions may have on the glass of the faceplate, is not the subject of the present application, but that of referent copending patent application Ser. No. (D5937).

Shadow mask support structures having a body comprised of a ceramic, and with a metal component for the attachment of a foil shadow mask, are further described in referent U.S. Pat. Nos. 4,737,681 and 4,745,330 of common ownership herewith, and in referent copending applications Ser. Nos. 178,175 and 192,412, also of common ownership.

The Q-height of the mask support structure of a cathode ray tube varies with the size of the tube in which the structure is to be used, and the pitch of the associated mask. For example, the Q-height of tube with a 14-inch diagonal measure and 0.3 mm pitch is about 9/32 of an inch, while a tube with a 35-inch diagonal measure and a pitch of 0.3 mm requires a Q-height of about one inch. Support structures having Q-height adjustable means according to the invention can readily be sized to adapt to various Q-heights.

The ceramic component of a mask support structure having Q-height adjustable means, such as ceramic component 82 depicted in FIG. 4, can be made by extrusion, in which a rail of desired length can be formed. Ceramic components can also be made by injection molding. Ceramic segments can be made to a precision size by dry pressing and sintering the powdered ceramic composition. The ceramic formulation is thoroughly blended (homogenized) by wet mixing the ingredients and spray-drying them to a uniform, fine particle size. Particle size is typically −180 mesh +325 mesh, or less than 180 mesh (0.0031 inch) and greater than 325 mesh (0.0017 inch).

In the dry pressing process, the powder is compacted in a die on an automatic mechanical press. The powder is compressed into the desired shape between a top and bottom punch while confined on the sides by a die. By proper process control of particle size and bulk density of the powder, the dimensions and unfired density of the pressed ceramic components can be accurately predicted. A uniform and predictable unfired density will provide a uniform shrinkage upon sintering, and thus a sintered component of very accurate size in its final form. The ceramic components are removed from the press, set on a refractory plate of required flatness and sintered in a desired temperature and time sequence to vitrify the composition and ensure that there will be no porosity; ceramic non-porosity is critical in vacuum tubes of the cathode ray tube type to prevent entrapment and later release of contaminants such as the slurries used in the phosphor screening process.

The surface of the Q-height adjustable means that provides for receiving and securing the shadow mask; viz., metal components such as indicated by reference number 90A in FIG. 4, and reference number 138 in FIG. 8, are preferably ground before being slidable inserted into the respective U-shaped members. Grinding of the mask-receiving member before assembly of the support structure, and its attachment to the faceplate ensures that the surface of the Q-height adjustment means will be acceptably flat and planar for receiving and securing the mask.

A prime benefit of mask support structures having Q-height adjustable means according to the invention is that it is unnecessary to grind "in situ" the mask-receiving surfaces of the structures to provide a flat surface for receiving and securing the mask, and to provide the proper Q-height. In situ grinding is grinding by a separate operation after the rail assemblies comprising the support structure are secured to the faceplate. Such finish grinding of an in situ mask support structure is described and claimed in referent copending application Ser. No. 140,464 of common ownership herewith.

Another benefit provided by a mask support structure having Q-height adjustable means is that the structure can be installed after a multi-color phosphor screen is formed on the faceplate; thereafter, a shadow mask support structure having Q-height adjustment means according to the invention is secured to the inner surface of the faceplate on opposed sides of the screen, after which a tensed foil shadow mask is affixed to the support structure. The benefit of a Q-height adjustable support structure is especially significant with regard to the interchangeable mask process which permits the union of any shadow mask with any screened faceplate. Interchangeable mask apparatus and process utilizing the flat tension mask are fully described and claimed in referent copending application Ser. No. 223,475 and its two continuations-in-part: Ser. Nos. 370,204 and 405,378, of common ownership herewith. It is notably difficult to form the precision screen required by the interchangeable mask system when the mask support structure is attached in place on the faceplate, as the structure is very much in the way of any screen-forming process. This is especially true when the screen is formed by a contact printing process rather than the well-known photolithographic process of printing cathodoluminescent screens. If the mask support structure is not present—a benefit of the present invention, and is thus out of the way of the printing rollers, the flat sheets of faceplate glass can be handled and printed much like so many sheets of paper.

It is notable that mask support structures having Q-height adjustment means according to the invention can as well be installed before the screen is installed. This is the normal production procedure in cathode ray tubes that are not intended for interchangeable mask systems. The advantage provided by mask support structures having Q-height adjustable means according to the invention is based on the fact that no grinding of the in situ structure would be necessary.

While a particular embodiment of the invention has been shown and described, it will be readily apparent to those skilled in the art that changes and modifications may be made in the inventive means and process without departing from the invention in its broader aspects, and therefore, the aim of the appended claims is to cover all such changes and modifications as fall within the true spirit and scope of the invention.

I claim:

1. A tension mask color cathode ray tube including a glass faceplate having on its inner surface a centrally disposed, rectangular screen having on opposed sides thereof a shadow mask support structure including Q-height adjustment means for receiving and securing said mask, said Q-height adjustment means providing for Q-height adjustment prior to the securing of said mask.

2. A tension mask color cathode ray tube including a glass faceplate having on its inner surface a centrally disposed, rectangular screen having on opposed sides thereof a shadow mask support structure comprising first means secured to said inner surface, and second means slidable in or on said first means for receiving and securing said mask, said second means providing for Q-height adjustment of said mask support structure prior to the securing of said mask.

3. The tension mask color cathode ray tube according to claim 2 wherein said first means is composed of ceramic and said second means is composed of metal.

4. The tension mask color cathode ray tube according to claim 3 wherein said first means comprises a ceramic base supporting a U-shaped metal section for slidably receiving said second means.

5. The tension mask color cathode ray tube according to claim 2 wherein said first and second means are composed of metal.

6. The tension mask color cathode ray tube according to claim 2 wherein said first means comprises an upright, U-shaped metal section for slidably receiving said second means.

7. The tension mask color cathode ray tube according to claim 6 wherein said second means is affixed at said predetermined Q-height by welding.

8. The tension mask color cathode ray tube according to claim 2 wherein said first means comprises a U-shaped metal member and said second means comprises a metal member that is polygonal in cross-section that is slidable in said first means, said polygonal member having a flat surface for receiving and securing said mask.

9. The tension mask color cathode ray tube according to claim 2 wherein said first means comprises a U-shaped metal member and said second means comprises a metal member that is round in cross-section that is slidable in said first means.

10. The tension mask color cathode ray tube according to claim 9 wherein said round metal member is affixed at said predetermined Q-height by welding.

11. The tension mask color cathode ray tube according to claim 10 wherein said weldments are high-energy-density beam weldments.

12. A tension mask color cathode ray tube including a glass faceplate having on its inner surface a centrally disposed, rectangular screen having on opposed sides thereof a shadow mask support structure comprising first means of ceramic secured to said inner surface, and second U-shaped metal means attached to said first means for slidably receiving Q-height adjustment means that provides for receiving and securing a shadow mask in tension, said Q-height adjustment means providing for Q-height adjustment of said mask support structure prior to securing said mask.

13. A tension mask color cathode ray tube including a glass faceplate having on its inner surface a centrally disposed, rectangular screen having on opposed sides thereof an upright U-shaped metal shadow mask support structure secured to said inner surface, said structure having a Q-height adjustment means for receiving and securing said mask, said member providing for Q-height adjustment prior to securing said mask.

14. A tension mask color cathode ray tube including a glass faceplate having on its inner surface a centrally disposed, rectangular screen having on opposed sides thereof an upright U-shaped metal shadow mask support structure slidably holding a movable part in the shape of a polygon with a flat side of said polygon oriented uprightly for receiving and securing said mask, said movable part providing for Q-height adjustment prior to securing said mask.

15. For use in the manufacture of a tension mask color cathode ray tube having a glass faceplate with a metal shadow mask support structure affixed to the inner surface thereof, said structure having Q-height adjustment means for receiving and securing said mask, a fixture having gauging means and holding means for setting and holding said Q-height adjustment means at a predetermined Q-height prior to the installation said mask.

16. The fixture of claim 15 wherein said gauging means includes a base for contacting said inner surface of said faceplate to establish said predetermined Q-height.

17. The fixture of claim 16 wherein said base includes means for adjusting said fixture to provide predetermined, different Q-heights.

18. The fixture of claim 16 wherein said base is fixed at a predetermined Q-height.

19. The fixture of claim 15 wherein said holding means comprises magnetic means.

20. The fixture of claim 15 wherein said fixture provides access for securement means for affixing said Q-height adjustment means at said predetermined Q-height.

21. The fixture of claim 20 wherein said securement means comprises high-energy-density beam welding means.

22. The fixture of claim 21 wherein said high-energy-density beam welding means comprises at least one laser beam.

23. For use in the manufacture of a tension mask color cathode ray tube having a glass faceplate with a shadow mask support structure affixed to the inner surface thereof, and having Q-height adjustment means for receiving and securing said mask, a fixture including gauging means comprising a base for contacting said inner surface for setting said Q-height adjustment means to a predetermined Q-height, and holding means comprising magnetic means for holding said Q-height adjustment means at said predetermined Q-height prior to installation of said mask.

24. For use in the manufacture of a tension mask color cathode ray tube having a glass faceplate with a shadow mask support structure affixed to the inner surface thereof, and having Q-height adjustment means for receiving and securing said mask, a fixture including gauging means comprising a base having adjustment means for contacting said inner surface and adjusting said Q-height adjustment means to a predetermined Q-height, and holding means comprising magnetic means for holding said Q-height adjustment means at said predetermined Q-height, said fixture including means for providing access to said Q-height adjustment means for affixing said Q-height adjustment means to said predetermined Q-height by high-energy beam weldments.

25. For use in the manufacture of a tension mask color cathode ray tube having a glass faceplate with a shadow mask support structure affixed to the inner surface thereof by cement means, said mask support structure having a mask-receiving surface, fixture means for establishing a predetermined Q-height between said mask-receiving surface and said glass faceplate inner surface, said fixture means having Q-height spacer means for engaging said glass faceplate inner surface and said mask-receiving surface to accurately space one from the other, said fixture means, in making contact with both glass faceplate inner surface and mask-receiving surface, causing said mask support structure to have a predetermined Q-height relative to said faceplate as determined by said Q-height spacer means.

* * * * *